United States Patent [19]

Lipukhim et al.

[11] Patent Number: 4,918,960

[45] Date of Patent: Apr. 24, 1990

[54] METHOD FOR REMOVING SCALE FROM A METAL STRIP

[76] Inventors: Jury V. Lipukhim, ploschad Metallurgov, 5, kv. 15; Leonid I. Danilov, ulitsa Vereschagina, 51, kv. 8; Eduard A. Garber, ulitsa M. Gorkogo, 85, kv. 17; Anatoly N. Subbotin, prospekt Pobedy, 120, kv. 14, all of Vologodskaya oblast Cherepovets, U.S.S.R.

[21] Appl. No.: 271,951

[22] PCT Filed: Jan. 15, 1988

[86] PCT No.: PCT/SU88/00012

§ 371 Date: Sep. 21, 1988

§ 102(e) Date: Sep. 21, 1988

[87] PCT Pub. No.: WO88/05348

PCT Pub. Date: Jul. 28, 1988

[30] Foreign Application Priority Data

Jan. 21, 1987 [SU] U.S.S.R. ..... 4175586

[51] Int. Cl.[5] ..... B21B 45/06

[52] U.S. Cl. ..... 72/40

[58] Field of Search ..... 29/81 R. 81 H; 72/39, 72/40, 53, 46

[56] References Cited

FOREIGN PATENT DOCUMENTS

| | | | |
|---|---|---|---|
| 519072 | 4/1955 | Belgium | 72/40 |
| 902378 | 9/1980 | U.S.S.R. . | |
| 887048 | 12/1981 | U.S.S.R. . | |
| 889174 | 12/1981 | U.S.S.R. | 72/39 |
| 1030056 | 7/1983 | U.S.S.R. . | |
| 1197752 | 12/1985 | U.S.S.R. . | |

*Primary Examiner*—E. Michael Combs
*Attorney, Agent, or Firm*—Lilling & Greenspan

[57] ABSTRACT

A method relates to the metallurgical industry. The claimed method includes stretching of the strip (1) flat in a horizontal position through the cleaning zone with abrasive ferromagnetic powder (6), in so doing, the strip is stretched first in one direction, then in the opposite, direction, enclosing the cleaning zone between the upper (2) and lower (3) branches formed on the strip (1).

4 Claims, 2 Drawing Sheets

METHOD FOR REMOVING SCALE FROM A METAL STRIP

BACKGROUND OF THE INVENTION

1. Field of the Invention

The present invention relates to the metallurgical industry, and more particularly, to a method for removing scale from a metal strip.

2. Description of the Prior Art

Known in the art is a method for removing scale from a metal strip (SU, A, 902378) wherein the strip passes vertically upwards through a working chamber which is filled with a ferromagnetic abrasive powder and has a means for pressing the powder to the strip which is made in the form of blades fixed to shafts mounted for rotation about axes 30°–40°. The blades press the powder from both sides to the surface of the moving strip, and magnets arranged behind the shafts facilitate compacting the powder, thereby effecting a two-sides removal of scale from the moving strip.

A disadvantage of this method consists in that a vertical position of the strip during treatment stipulates large dimensions of the working chamber as to height, which increases the height of the workshop building and crane tracks and this, in turn, entails additional capital costs. Besides, the working chamber is rather metal intensive, and an appreciable amount of expensive nonmagnetic steel is needed for its manufacture, and in the final analysis, at least three bypass rollers 1.1 to 1.2 m in diameter are required to transfer the strip from horizontal to vertical position and back, which involves additional expenditure of metal for the rollers per se and power to bend the strip therethrough.

Known in the art is a method for removing scale from a strip (SU, A, 887048), wherein powder and the strip being cleaned are pressed to each other, the strip moving flat in a horizontal position through slits in the side walls of the working chamber having the form of a tube, in so doing, the powder is fed to the chamber from the side and is pumped with the aid of a piston along the axis of the tube in the opposite end of which there is provided a valve to remove the powder.

This method has a number of advantages over the above-mentioned, namely, it does not require bypass rollers and bending of the strip therethrough, and the working chamber is markedly smaller in height. However, as tests show, it is difficult to realize this method in practice because the powder pressure against the strip along the chamber length (i.e., in the strip width) drastically declines due to appreciable losses for powder friction against the working chamber wall. As a result, the strip is cleaned nonuniformly in width, the chamber walls wear out quickly, power consumption for pumping the powder along the chamber is extremely high, the replacement of powder is complicated. Thus, the advantages of a strip horizontal position in this method cannot be actually realized.

Besides, the presence of a special tank for powder, i.e. a working chamber, not only compounds the cleaning method, but requires substantial costs for manufacturing this chamber and its maintenance.

SUMMARY OF THE INVENTION

The present invention has as its object to provide a method for removing scale from metal strips, wherein the scale removal is ensured through pressure created by the moving strip per se, without using the tank for holding ferromagnetic powder, which makes it possible to simplify the method realization, reduce the unit dimensions in length, and improve the quality of cleaning.

This aim is achieved by a method for removing scale from metal strips, comprising stretching the strip flat horizontally through the cleaning zone having a ferromagnetic abrasive powder, and mutual pressing of the powder and the surface of the strip being cleaned as the latter moves, as well as feeding the powder to the cleaning zone and its withdrawal from this zone. According to the invention, the strip is stretched through the cleaning zone first in one direction, then in the opposite one, thereby forming lower and upper branches from the strip, and the cleaning zone is arranged between these branches.

Accommodating the cleaning zone between the two-upper and lower branches of the strip stretched, first in one and then in the opposite directions allows a special vessel, namely, the working chamber be dispensed with during the realization of the given method, thereby simplifying the latter, markedly reducing the capital outlays and operational costs for its maintenance and repair, as well as decrease the dimensions as to the length of the process line. In so doing, a number of mechanisms of the working chamber become unnecessary, namely, a powder charging device, a valve mechanism for discharging waste powder from the chamber, a lock for introducing the strip to the working chamber which is provided with an electromagnet to make the process of removing scale from the strip still cheaper.

It is expedient that the power branch of the strip at the exit from the cleaning zone be turned 180° around the strip longitudinal axis.

Turning the lower branch of the strip beyond the cleaning zone 180° around its longitudinal axis permits the strip to be cleaned from both sides per one pass, because after this turn the upper branch of the strip gets into the cleaning zone which faces the abrasive powder by an uncleaned, side. The pouring of waste powder from the strip in the place of this turn appreciably simplifies the circulation and replacement of powder and rules out the necessity of providing for special devices, e.g., vibrating chutes to remove the waste powder from the cleaning zone.

In order to improve the quality of cleaning the strip, it is expedient that the upper and lower branches of the strip be bent in transverse planes in the cleaning zone and their side edges be drawn together.

Drawing together the side edges of the upper and lower branches of the strip in the cleaning zone by bending the strip in transverse planes makes it possible to diminish (or rule out completely) the spilling of powder from the cleaning zone through the side edges of the strip, thereby creating conditions for maintaining stable pressure of powder on the strip in the cleaning zone, which is necessary for achieving constant force conditions of cleaning over the strip length. Besides, compression of powder at the side edges of the strip appears to be greater than in the middle of its width which enhances the efficiency of removing the scale from the strip sections adjacent to the side edges where, as is known, the scale is stronger and is linked to the basic metal to a greater extent. Thus, drawing together the side edges of the opposite branches of the strip improves the quality of cleaning as a whole both along the length and width of the strip.

DESCRIPTION OF THE PREFERRED EMBODIMENT

Figure 1:
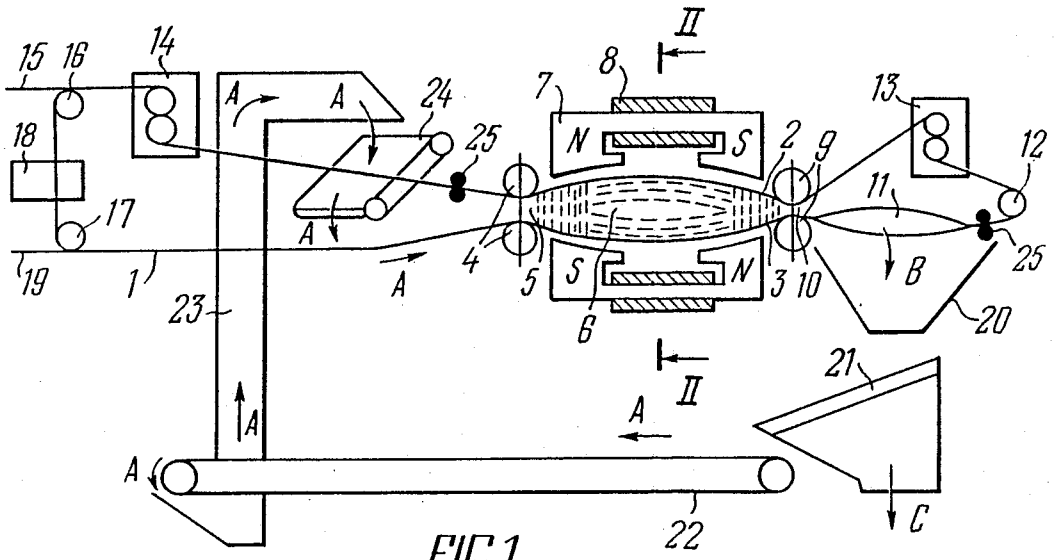
FIG. 1 schematically shown the process line for removing scale from the strip, according to the invention.

The claimed method for removing scale from a metal strip comprises stretching the strip flat horizontally first in one direction to form the lower branch of the strip, then bending upward 180° and stretching in the opposite direction to form the upper branch of the strip moving below the lower branch. At the same time ferromagnetic abrasive powder is fed into the space formed by two, namely the lower and upper branches of the strip, from one side, from the left (according to the drawing), and from the other side, e.g., to the right, it is discharged from this space. Regulating the quality of powder fed to the above-identified space, the strip velocity and the distance between the upper and lower branches of the strip at the ends of said space, the value of powder pressure on the strip, is changed to bring it to the value necessary for removing the scale from the strip surface. To enhance the efficiency of scale removal the magnetic cores of electromagnets are brought as close as possible to the moving branches of the strip from the outside of said space, the opposite poles of these magnetic cores being located opposite each other at the strip opposite branches. As a result, the magnetic fluxes cross the space between the opposite branches of the strip filled with powder which under action of these fluxes loses its free-flowing properties and improves abrasive effect on the strip surface to be cleaned.

If it is necessary that the strip be cleaned per one pass from both sides, the lower branch thereof is turned 180° around its longitudinal axis in the place where it leaves the cleaning zone, in so doing, at the place of said turn the used powder taken by the strip lower branch from the cleaning zone, is spontaneously spilled into its circulation and separation system.

In order to improve the quality of strip cleaning by means of the claimed method, the side edges of the upper and lower branches of the strip in the cleaning zone are additionally drawn together by bending the strip in transverse planes. The front and rear ends of the strip can be butt-welded, in this case, the strip is stretched through the cleaning zone formed by its two opposite branches, in an "infinite" mode, i.e., multiply, until the scale is fully removed.

Butt-welding of the front and rear ends of the strip and the transportation of the latter through the cleaning zone in an "infinite" mode permits the scale to be fully removed by means of one cleaning zone formed by the strip upper and lower branches. This expedient in case a small output of the scale removal section is assigned. Then, it is inexpedient that three-four cleaning zones with intermediate drawing stations be created along the length of the process line, since it would call for additional costs and greater production area. It is much cheaper to transport the strip via one cleaning zone in an "infinite" mode until it is fully cleaned (as experience shows it requires not more than three-four passes). The butt-welding of the front and rear ends provides for aligning these ends in space in view of the return of the front end of the strip because of the movement in the cleaning zone of its branches in opposite directions.

Figure 2:
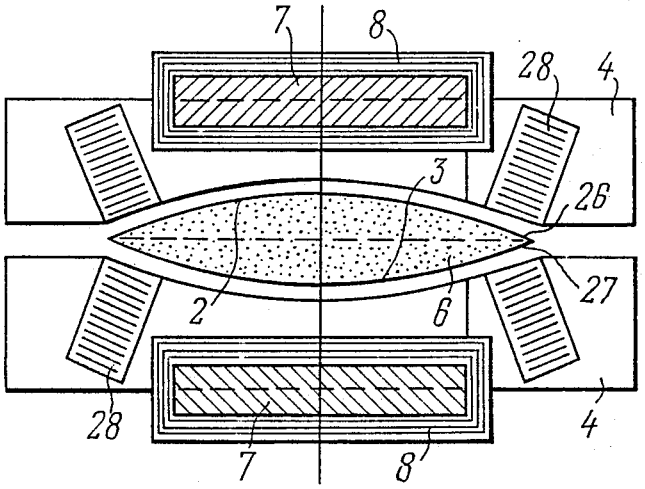
FIG. 2 is a cross section taken along line II-II in FIG. 1.

The claimed method for removing scale from the metal strip is accomplished in a process line represented in FIG. 1 and 2, wherein a strip 1 rests with its upper 2 and lower 3 branches on pressure rollers 4 capable of drawing closer to each other to alter the size of a slit 5 between the upper 2 and lower 3 branches of the strip 1 to the left (according to FIG. 1) from the cleaning zone filled with powder 6.

Magnetic cores 7 of electromagnets with coils 8 are mounted with their opposite poles N and S on top and in the bottom with respect to the strip 1 from the outside of the cleaning zone. Arranged to the right of the cleaning zone (according to the drawing of FIG. 1) are pressure rollers 9 which analogously with the roller 4 are capable of closing with each other to alter the size of a slit 10 between the upper 2 and lower 3 branches of the strip 1.

In a section 11 the lower branch 3 of the strip 1 is turned 180° around its longitudinal axis, a bypass roller 12 is arranged to the right of the zone 11 and bypasses the strip 1 turning its lower branch 3 to the upper one 2. Then, the strip 1 passes with its upper branch 2 via a take up 13 intended for stretching the lower branch 3 of the strip 1 through the cleaning zone with powder 6 placed between the magnetic cores 7 with coils 8. To the left of the take-up 13 the upper branch 2 of the strip 1 makes up the upper boundary of the cleaning zone with powder 6 by means of upper pressure rollers 4 and 9 and the magnetic cores 7. A takeup 14 serves to stretch the upper branch 2 of the strip 1 through the cleaning zone.

In case the "infinite" mode is not realized in the cleaning method, the front end 15 of the strip 1 heads further to the left of the process line which may contain another two or three cleaning zones (not shown in the figure). Under the "infinite" operation mode the front end 15 is directed via the bypass roller 16 towards the bypass roller 17 via the end treatment unit 18 which comprises a loop accumulator, and cutting shears, a straight line seam welder for connecting the front end 15 of the strip 1 to its rear end 19 and a flash trimmer for levelling off the strip thickness in the place of end welding (machines incorporated in the unit 18 are not conventionally shown in the figure). To circulate and separate the abrasive powder provision is made for: a guide funnel 20, a vibrating separator 21, a conveyor 22, a bucket-type elevator 23, and a conveyer-feeder 24. To remove the remaining powder following the strip 1 turn section 11, provision is made for non-metal brushes 25 having a rotation drive (not shown in the figure). Rollers 28 whose axes are at sharp angles to the horizontal plane are provided to draw together the side edges 26 (FIG. 2) and 27 of the upper 2 and lower 3 branches of the strip 1 in the cleaning zone. From the side of each branch of the strip 1 the axes of the rollers 28 are combined into single blocks with respective magnetic cores 7 so that the upper and lower magnetic cores 7 with their coils 8 and roller28 can move closer or further apart from each other to form the strip 1 cleaning zone filled with powder 6.

The direction of the circulation of powder and scale is shown by arrows in FIG. 1 (arrow A - powder; arrow B - - the mixture of powder and scale; arrow C - scale).

The process of removing scale from a metal strip according to the claimed method is reffected as follows.

The front end 15 the strip 1 is first passed by the bypass roller 17 below the lower pressure roller 4, lower magnetic core 7, lower pressure roller 9. In so doing, the upper and lower pressure rollers 4, 9 and magnetic cores 7 are spaced apart from each other upward and downward, respectively, to the maximum distance for conveniency of setting up and movement of the strip 1. Following the passage below the lower roller 9 at the section 11, the strip 1 is turned 180° around the longitudinal axis, guided through between the nonmetal brushes 25 which are spread and immovably fixed, bypassed around the bypass roller 12, let through the take-up 13, beneath the pressure roller 9, the upper magnetic core 7 and the upper roller 4. Further on, the front end 15 is passed through the take-up 14.

Should the conventional rather than "infinite" mode be realized, the front end 15 of the strip 1 is directed further to the left along the process line. Under the "infinite" mode the front end 15 is bypassed around the bypass roller 16 and is introduced to the block 18 for processing the ends, where it is butt-welded with the rear end 19 of the strip 1 which is passed beforehand through the loop accumulator and the flash trimmer incorporated in the block 18. Thereupon, the flash is removed from the weld. With this the process of setting and preparing the strip for operation is completed.

Then the drives of the take-ups 13, 14 are switched on and the strip 1 start moving. Thereupon, the drives of the vibrating separator 21 the ventilator to pump off scale from below the vibrating separator 21 (conventionally not shown in FIG. 1), conveyor 22, elevator 23 and feeder 24 are switched on. A portion of powder 6 (from a stand-by bunker which is not conventionally shown in the figure) required for cleaning is fed to the receiving funnel in the lower part of the elevator 23, the powder is fed along the elevator 23 (in the direction of arrows "A") to the feeder 24 and from there to the lower branch 3 of the strip 1 which, moving to the right, conveys the powder 6 to the cleaning zone located between the rollers 4 and 9. In order to fill the cleaning zone with powder 6 the mechanism for moving the rollers 9 is switched on with the result that the upper and lower rollers 9 close with each other reducing to the minimum the slit 10 between the upper 2 and lower 3 branches of the strip 1 resting on these rollers. This makes it difficult for the powder 6 to find its way to the section 11, the powder 6 fills the cleaning zone between the rollers 4 and 9 an magnetic cores 7, whereupon, the upper and lower rollers 4 draw together, leaving the minimal slit 5, sufficient for additional feeding fresh powder 6 to the cleaning zone with a present flow rate of the powder 6 per unit of time. At the same time the upper and lower magnetic cores 7 as well as the upper and lower rollers 28 close with each other to establish such dimensions of the slits 5 and 10 between the upper and lower rollers 4 and 9 that the amount of powder 6 taken from the cleaning zone by the lower branch 3 of the strip 1 to the section 11 would equal the amount of powder 6 introduced to the cleaning zone between the rollers 4. Thus, the cleaning zone enclosed between the upper 2 and lower 3 branches of the strip 1 pressed to the powder by the rollers 4, 9 and 28 and surrounded by the magnetic cores 7 turns out to be formed and prepared to remove scale from the strip 1. Furtheron, the drive to rotate the brushes 25 is switched on and the latter are brought to the strip 1, power is supplied to the coils of the electromagnets 8.

Magnetic fluxes reducing the looseness of powder 6 and improving its abrasive properties are induced between the poles N and S of the magnetic cores 7. The surfaces of the strip 1 facing the powder 6 are cleaned. Since the strip 1 is turned 180° around the longitudinal axis at the section 11, it is cleaned from both sides. The forces of pressing the powder 6 to the strip 1, requisite for scale destruction, are created by the rollers 4, 9 an 28 and are ensured by the mechanisms pressing them to the strip 1 (these mechanisms are conventionally not shown in the figure). The forces required to stretch the strip 1 and overcome its movement resistance from the side of the powder 6 are ensured by the take-ups 13 and 14.

As the strip 1 moves, its lower branch 3 takes out a certain amount of abrasive powder 6 mixed with scale from the cleaning zone into the slit 10 between the rollers 9, and introduces the same amount of pure powder 6 into the cleaning zone with the aid of the lower branch 3 of the strip 1 between the rollers 4 so that the mass of powder 6 and its pressure on the strip 1 in the cleaning zone remain constant.

Upon entering the section 11 in the process of cleaning through the slit 10 between the rollers 9, the powder 6 mixed with scale 4 arbitrarily spills via the funnel 20 to the vibrating separator 21 owing to the turn of the strip 1 at this section 180°. The remaining powder 6 is removed by the brushes 25, thereby guaranteeing the prevention of the ingress of powder 6 particles between the bypass roller 12 and the strip 1 which, in turn, rules out the damage of the latter. The mixture of powder 6 with scale which found its way into the vibrating separator 21 is divided as follows: the scale is taken out of the mixture via the mesh of the vibrating separator 21 and is pumped in the direction of arrow "C", while the scale-free powder 6 enters the receiving funnel of the elevator 23 along the conveyer 22 in the direction of arrows "A". The elevator 23 lifts the powder and spills it to the feeder 29 belt, whence the powder again finds its way to the lower branch 3 of the strip 1 for re-use.

The power 6 particles carried 1 away, by the upper branch 2 of the strip 1 from the cleaning zone to the left, are removed from the strip by the brushes 25, fall onto the lower branch 3 and again enter the cleaning zone. To reduce the spilling of powder from the lower branch 3 of the strip 4 ahead of the rollers, it is trough-shaped, by bending in a transverse plane, e.g., by means of rollers analogous to rollers 28 (these rollers are not conventionally shown in FIG. 1,2). That part of powder 6 which does spill from the lower branch 3 of the strip 1 through its side edges, gets into the conveyer 22, thus returning to the powder circulation system.

Compared to the prototype the claimed method makes it possible to simplify the process of its realization, improve the quality of cleaning, reduce capital outlays and the dimensions along the length the process line, while excluding from the specification metal intensive units complex in manufacture such as the body of the working chamber, a charging bunker, a valve discharging mechanism, the lock with an electromagnet, appreciably decreases the expenditures from the manufacture of this facility.

The invention can be realized to advantage in the plate and sheet rolling.

We claim:

1. A method of removing scale from a metal strip, comprising the steps of stretching and flattening said strip in a horizontal position first in one direction and then another direction opposite to said one direction in a manner to form spaced, horizontally arranged upper and lower sections of said strip; moving the strip, including the upper and lower sections thereof, through a cleaning zone defined between said strip sections; introducing abrasive ferromagnetic cleaning powder into said cleaning zone; pressing said powder against the surfaces of said upper and lower strip sections during their movement through said cleaning zone to descale said strip; and, withdrawing said powder, scale, and descaled strip from said cleaning zone.

2. A method according to claim 6, further including the step of turning the lower section (3) of the strip (1)

3. A method according to claim 1, further including the step of bending the upper (2) and lower (3) section of the strip (1) in the cleaning zone in transverse planes relative to each other simultaneously drawing together their side edges.

4. A method according to claim 2, further including the step of bending the upper (2) and lower (3) sections of the strip (1) in the cleaning zone in transverse planes relative to each other simultaneously drawing together their side edges.

* * * * *